US012031302B2

(12) United States Patent
Wu et al.

(10) Patent No.: US 12,031,302 B2
(45) Date of Patent: Jul. 9, 2024

(54) EXCAVATOR

(71) Applicant: SUMITOMO HEAVY INDUSTRIES, LTD., Tokyo (JP)

(72) Inventors: Chunnan Wu, Kanagawa (JP); Yusuke Sano, Kanagawa (JP); Yoshiyasu Itsuji, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 540 days.

(21) Appl. No.: 16/775,389

(22) Filed: Jan. 29, 2020

(65) Prior Publication Data

US 2020/0165799 A1 May 28, 2020

Related U.S. Application Data

(63) Continuation of application No. PCT/JP2018/028304, filed on Jul. 27, 2018.

(30) Foreign Application Priority Data

Jul. 31, 2017 (JP) ..... 2017-147669

(51) Int. Cl.
*G01S 19/42* (2010.01)
*E02F 3/65* (2006.01)
(Continued)

(52) U.S. Cl.
CPC ..... *E02F 9/262* (2013.01); *E02F 3/651* (2013.01); *E02F 9/2033* (2013.01);
(Continued)

(58) Field of Classification Search
CPC ..... G01S 13/931; G01S 2013/932; G01S 2013/93271; G01S 17/931; G01S 15/931; G01S 19/42; G01S 2013/9322; G01S 5/0027; G01S 17/86; G01S 13/867; G01S 19/41; G01S 19/37; G01S 13/86;
(Continued)

(56) References Cited

U.S. PATENT DOCUMENTS 4,465,155 A * 8/1984 Collins ..... G05D 1/0225 299/1.4
6,161,625 A * 12/2000 Mati ..... A01C 5/04 172/111
(Continued)

FOREIGN PATENT DOCUMENTS

JP H11-222882 8/1999
JP 2014-006577 1/2014
(Continued)

OTHER PUBLICATIONS

International Search Report for PCT/JP2018/028304 mailed on Oct. 9, 2018.

*Primary Examiner* — Edwin J Toledo-Duran
(74) *Attorney, Agent, or Firm* — IPUSA, PLLC

(57) ABSTRACT

An excavator according to an embodiment of the present invention includes a lower traveling body, an upper turning body with an attachment mounted on the lower traveling body, and a controller installed in the upper turning body. The controller is configured to restrict movement of the lower traveling body based on information about terrain around the upper traveling body.

20 Claims, 10 Drawing Sheets

(51) Int. Cl.
*E02F 9/20* (2006.01)
*E02F 9/24* (2006.01)
*E02F 9/26* (2006.01)

(52) U.S. Cl.
CPC ..... *E02F 9/2041* (2013.01); *E02F 9/24* (2013.01); *E02F 9/265* (2013.01)

(58) Field of Classification Search
CPC ..... G01S 19/40; G01S 17/89; G01S 5/009; G01S 5/0009; G01S 19/25; G01S 7/003; G01S 19/43; G01S 13/862; G01S 19/26; G01S 19/32; G01S 13/04; G01S 19/252; G01S 17/88; G01S 13/42; G01S 13/584; G01S 13/89; G01S 7/497; G01S 7/4972; G01S 7/04; G01S 15/88; G01S 7/411; G01S 13/56; G01S 13/426; G01S 5/0054; G01S 5/021; G01S 15/04; G01S 17/08; G01S 17/93; G01S 17/58; G01S 13/88; G01S 15/42; G01S 17/66; G01S 15/876; G01S 5/04; G01S 1/047; G01S 15/93; G01S 17/06; G01S 17/74; G01S 19/00; G01S 19/31; G01S 2015/937; G01S 2201/01; G01S 11/14; G01S 13/06; G01S 13/02; G01S 13/08; G01S 15/06; G01S 15/66; G01S 3/023; G01S 2007/52009; G01S 2007/52011; G01S 7/021; G01S 5/08; G01S 7/56; G01S 1/7038; G01S 3/7803; G01S 3/7862; G01S 7/10; G01S 1/08; G01S 1/18; G01S 13/50; G01S 13/755; G01S 13/762; G01S 13/785; G01S 7/2922; G01S 7/2923; G01S 7/2925; G01C 21/32; G01C 21/20; G01C 21/34; G01C 15/00; G01C 21/3617; G01C 15/02; G01C 21/3848; G01C 21/3652; G01C 15/002; G08G 1/16; G08G 1/164; G08G 5/025; G08G 5/04; G08G 3/02; G08G 9/02; E02F 9/262; E02F 3/651; E02F 9/2033; E02F 9/2041; E02F 9/24; E02F 9/265
See application file for complete search history.

(56) References Cited

U.S. PATENT DOCUMENTS 6,226,572 B1 * 5/2001 Tojima ..... G05D 1/0297 701/484
6,252,544 B1 * 6/2001 Hoffberg ..... H04B 7/18576 701/445
6,327,522 B1 * 12/2001 Kojima ..... B60K 35/00 701/1
6,363,632 B1 * 4/2002 Stentz ..... E02F 9/24 701/50
9,497,422 B2 * 11/2016 Mitsuta ..... H04N 7/181
9,827,677 B1 * 11/2017 Gilbertson ..... B25J 15/0019
9,827,678 B1 * 11/2017 Gilbertson ..... A47L 11/4055
10,761,537 B1 * 9/2020 Ready-Campbell ... G01C 21/20
11,149,406 B2 * 10/2021 Doi ..... E02F 9/24
11,643,795 B2 * 5/2023 Otsuki ..... G08B 21/02 340/691.6
2003/0006071 A1 * 1/2003 Stump ..... G01S 13/86 175/45
2004/0158355 A1 * 8/2004 Holmqvist ..... G05D 1/0236 701/23
2005/0103006 A1 * 5/2005 Yoshino ..... E02F 9/2207 60/413
2006/0293856 A1 * 12/2006 Foessel ..... B60W 30/09 701/301
2007/0026989 A1 * 2/2007 Swick ..... B60K 17/105 475/72
2007/0119163 A1 * 5/2007 Tatsuno ..... F16H 61/4148 60/493
2009/0259399 A1 * 10/2009 Kotejoshyer ..... G01S 7/4802 701/300
2009/0259400 A1 * 10/2009 Coats ..... G01S 13/87 701/301
2010/0079367 A1 * 4/2010 Yokota ..... G01D 7/02 340/461
2010/0223008 A1 * 9/2010 Dunbabin ..... E02F 9/262 701/301
2012/0271504 A1 * 10/2012 Reiners ..... E02F 9/2054 701/439
2013/0182066 A1 * 7/2013 Ishimoto ..... E02F 9/261 348/38
2013/0261873 A1 * 10/2013 Pal ..... G01V 3/38 701/28
2014/0354813 A1 * 12/2014 Ishimoto ..... G06T 11/60 348/148
2015/0254911 A1 * 9/2015 Kimura ..... G05B 15/02 701/50
2016/0024758 A1 * 1/2016 Ishimoto ..... G06T 3/047 348/139
2017/0120822 A1 * 5/2017 Petzold ..... E02F 9/2054
2017/0305018 A1 * 10/2017 Machida ..... B25J 9/1674
2017/0307362 A1 * 10/2017 Vandapel ..... G01S 17/89
2018/0182120 A1 6/2018 Izumikawa
2018/0245315 A1 * 8/2018 Kaiso ..... G06T 7/70
2018/0274206 A1 * 9/2018 Kozui ..... E02F 9/123
2018/0347147 A1 * 12/2018 Doi ..... B60W 30/00
2019/0003152 A1 1/2019 Nakamura et al.
2019/0017246 A1 * 1/2019 Okada ..... E02F 3/32
2019/0170879 A1 * 6/2019 Kinoshita ..... G01B 21/18
2020/0299924 A1 * 9/2020 Kurokawa ..... E02F 9/262
2021/0214923 A1 * 7/2021 Fujiwara ..... E02F 9/262
2022/0136215 A1 * 5/2022 Shiratani ..... E02F 9/261 701/50

FOREIGN PATENT DOCUMENTS

JP 2016-172963 9/2016
JP 2017-014726 1/2017
WO 2017/033991 3/2017

* cited by examiner

EXCAVATOR

CROSS-REFERENCE TO RELATED APPLICATION

This application is a continuation of International Application No. PCT/JP2018/028304 filed on Jul. 27, 2018 and designated the U.S., which claims priority to Japanese Patent Application No. 2017-147669 filed on Jul. 31, 2017. The contents of these applications are incorporated herein by reference in their entirety.

BACKGROUND

Technical Field

The present disclosure relates to an excavator having a lower traveling body.

Description of Related Art

Conventionally, an excavator equipped with a measuring device that measures terrain around an upper turning body based on a pair of stereo images captured by a camera mounted on the upper turning body is known. According to this configuration, the measuring device can generate and display terrain data at a work site in real time.

SUMMARY

An excavator according to an embodiment of the present invention includes a lower traveling body, an upper turning body with an attachment mounted on the lower traveling body, and a controller installed in the upper turning body. The controller is configured to restrict movement of the lower traveling body based on information about terrain around the upper traveling body.

DETAILED DESCRIPTION

An operator of an excavator may forget a direction of a lower traveling body when repeating moving operations, turning operations, and attachment operations in order to perform excavation. Then, the lower traveling body may be moved in an opposite direction to an intended direction.

Even if the excavator is equipped with a measuring device such as a camera, because the measuring device only generates and displays terrain data based on images captured by the measuring device, the excavator cannot be stopped even if there is a hole in a direction of movement of the excavator. As a result, a body of the excavator may become unstable.

In view of the above, it is desirable to provide an excavator that can prevent its body from becoming unstable.

Figure 1:
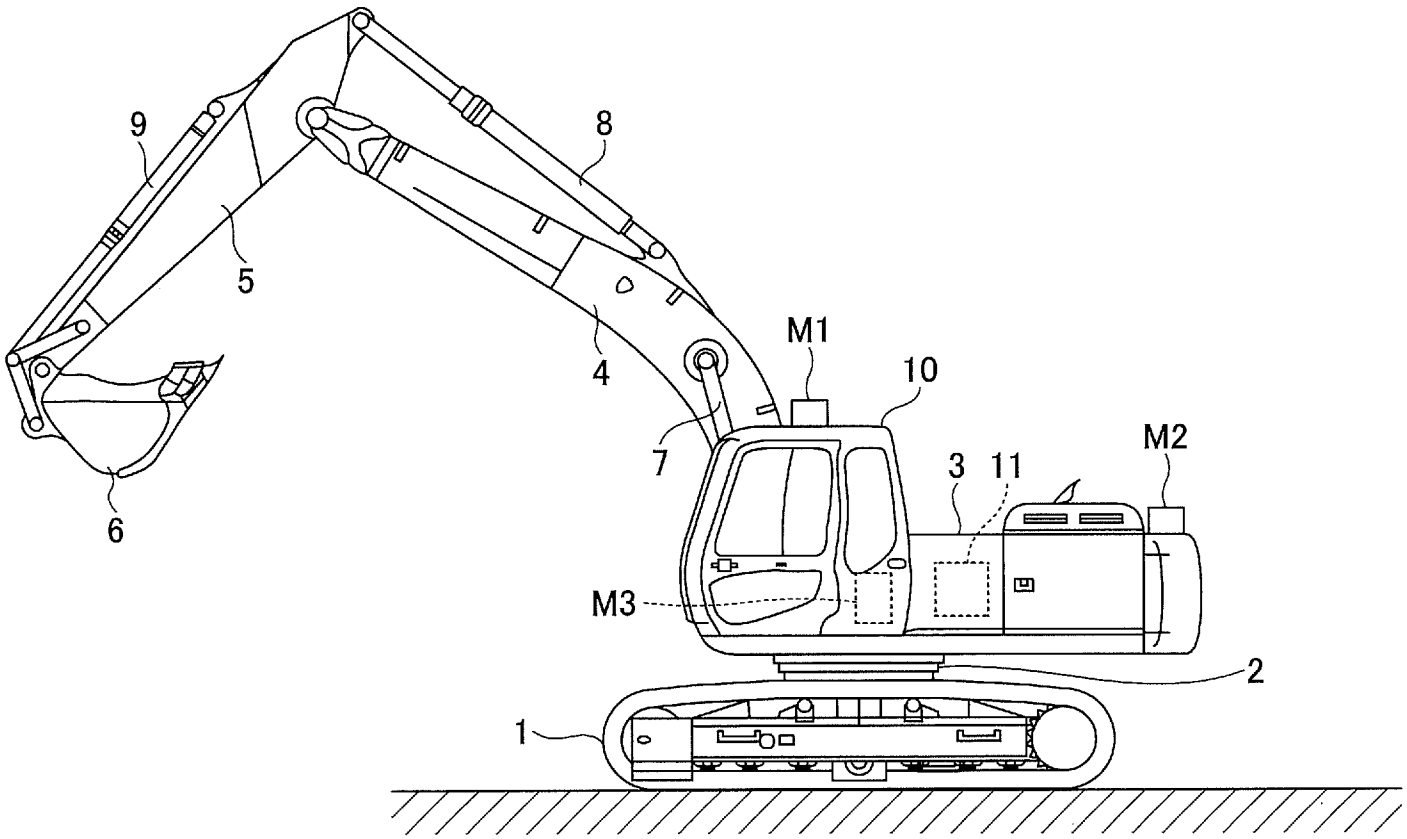
FIG. 1 is a side view of an excavator according to an embodiment of the present invention.

In the following, an excavator as a construction machine according to an embodiment of the present invention will be described with reference to FIG. 1. FIG. 1 is a side view of the excavator according to the embodiment of the present invention. An upper turning body 3 is mounted on a lower traveling body 1 of the excavator through a turning mechanism 2. A boom 4 is attached to the upper turning body 3. An arm 5 is attached to a tip of the boom 4, and a bucket 6 is attached to a tip of the arm 5. The boom 4, the arm 5 and the bucket 6 as working elements constitute an excavation attachment, which is an example of an attachment. The boom 4 is driven by a boom cylinder 7. The arm 5 is driven by an arm cylinder 8. The bucket 6 is driven by a bucket cylinder 9. The upper turning body 3 is provided with a cab 10, and is equipped with a power source such as an engine 11. A communication device M1, a positioning device M2, and an orientation detecting device M3 are attached to the upper turning body 3.

The communication device M1 is configured to control communication between the excavator and the outside. In the present embodiment, the communication device M1 controls radio communication between a GNSS (Global Navigation Satellite System) surveying system and the excavator. Specifically, the communication device M1 acquires terrain information of a work site when an excavator operation is started, for example, once a day. The GNSS surveying system employs, for example, a networked RTK-GNSS positioning system.

The positioning device M2 is configured to measure a position of the excavator. The positioning device M2 may be configured to measure a direction of the excavator. In the present embodiment, the positioning device M2 is a GNSS receiver incorporating an electronic compass, and is attached to the upper turning body 3. The positioning device M2 measures latitude, longitude, and altitude of a location on which the excavator is positioned, and measures a direction of the excavator (upper turning body 3). The positioning device M2 may include a pivot angle detecting device for detecting the pivot angle of the upper turning body 3 with respect to the lower traveling body 1. According to this configuration, the positioning device M2 can measure the direction of the lower traveling body 1 based on the direction of the excavator (upper turning body 3). However, the direction of the lower traveling body 1 may be measured based on another GNSS receiver.

The orientation detecting device M3 is configured to detect an orientation of the attachment. For example, the orientation detecting device M3 can obtain a path of movement of the attachment according to an operation. In the present embodiment, the orientation detecting device M3 detects the orientation of the excavation attachment.

Figure 2:
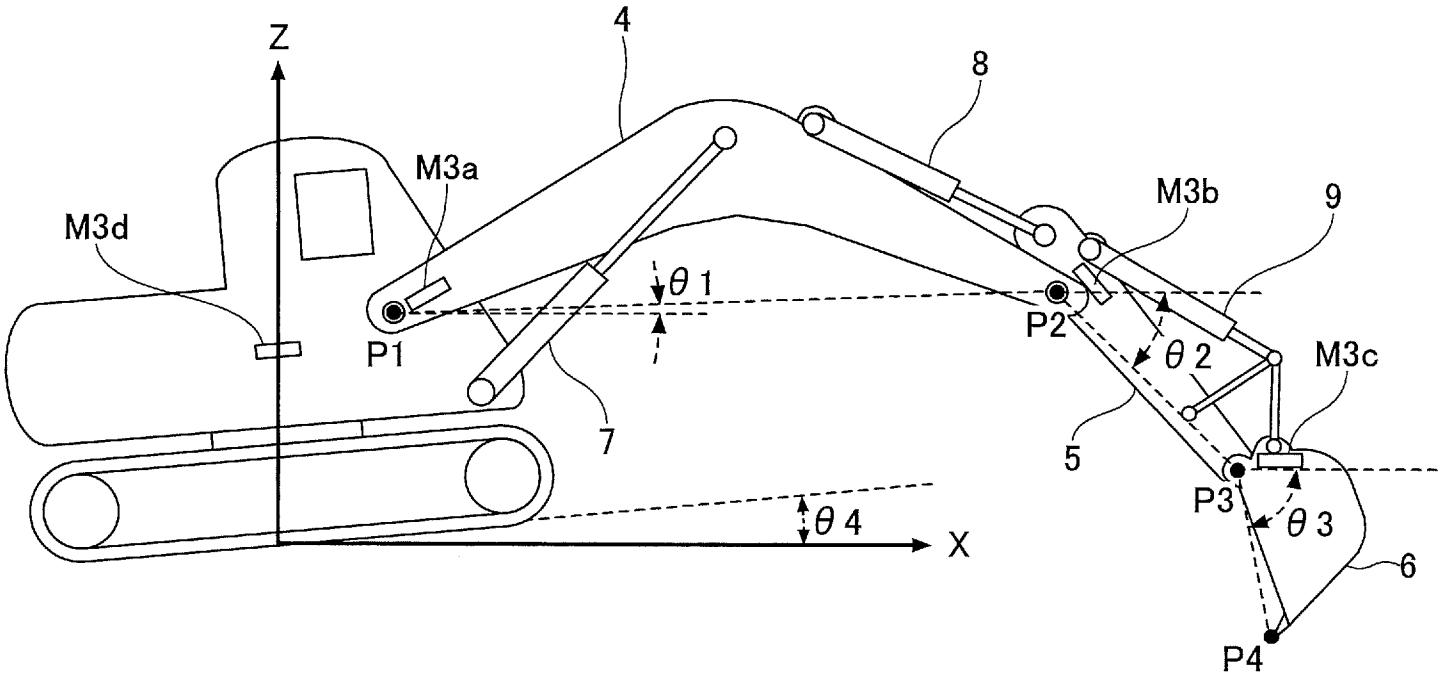
FIG. 2 is a side view of the excavator illustrating an example of a configuration of an orientation detecting device mounted on an excavator of FIG. 1.

FIG. 2 is a side view of the excavator illustrating an example of a configuration of various sensors constituting the orientation detecting device M3 installed in the excavator in FIG. 1. Specifically, the orientation detecting device M3 includes a boom angle sensor M1*a*, an arm angle sensor M3*b*, a bucket angle sensor M3*c*, and a body tilt sensor M3*d*.

The boom angle sensor M3*a* is configured to acquire a boom angle θ1. The boom angle θ1 is, for example, an angle with respect to a horizontal line, of a line connecting a boom foot pin position P1 and an arm connection pin position P2 in an XZ plane.

The arm angle sensor M3*b* is configured to acquire an arm angle θ2. The arm angle θ2 is, for example, an angle with respect to the horizontal line, of a line connecting the arm connection pin position P2 and a bucket connection pin position P3 in the XZ plane.

The bucket angle sensor M3*c* is configured to acquire the bucket angle θ3. The bucket angle θ3 is, for example, an angle with respect to the horizontal line, of a line connecting the bucket connection pin position P3 and a bucket tip position P4 in the XZ plane.

In the present embodiment, the boom angle sensor M3*a* is configured by a set of an acceleration sensor and a gyro sensor. However, the boom angle sensor M3*a* may be configured by a rotation angle sensor for detecting a rotation angle of the boom foot pin, a stroke sensor for detecting a stroke amount of the boom cylinder 7, or a tilt sensor for detecting a tilt angle of the boom 4. The same applies to the arm angle sensor M3*b* and the bucket angle sensor M3*c*.

The body tilt sensor M3*d* is configured to acquire a tilt angle θ4 of the excavator about a Y-axis and a tilt angle θ5 (not illustrated) of the excavator about the X-axis. The body tilt sensor M3*d* includes, for example, a 2-axis tilt (acceleration) sensor or a 3-axis tilt (acceleration) sensor. The XY plane of FIG. 2 is a horizontal plane.

Figure 3:
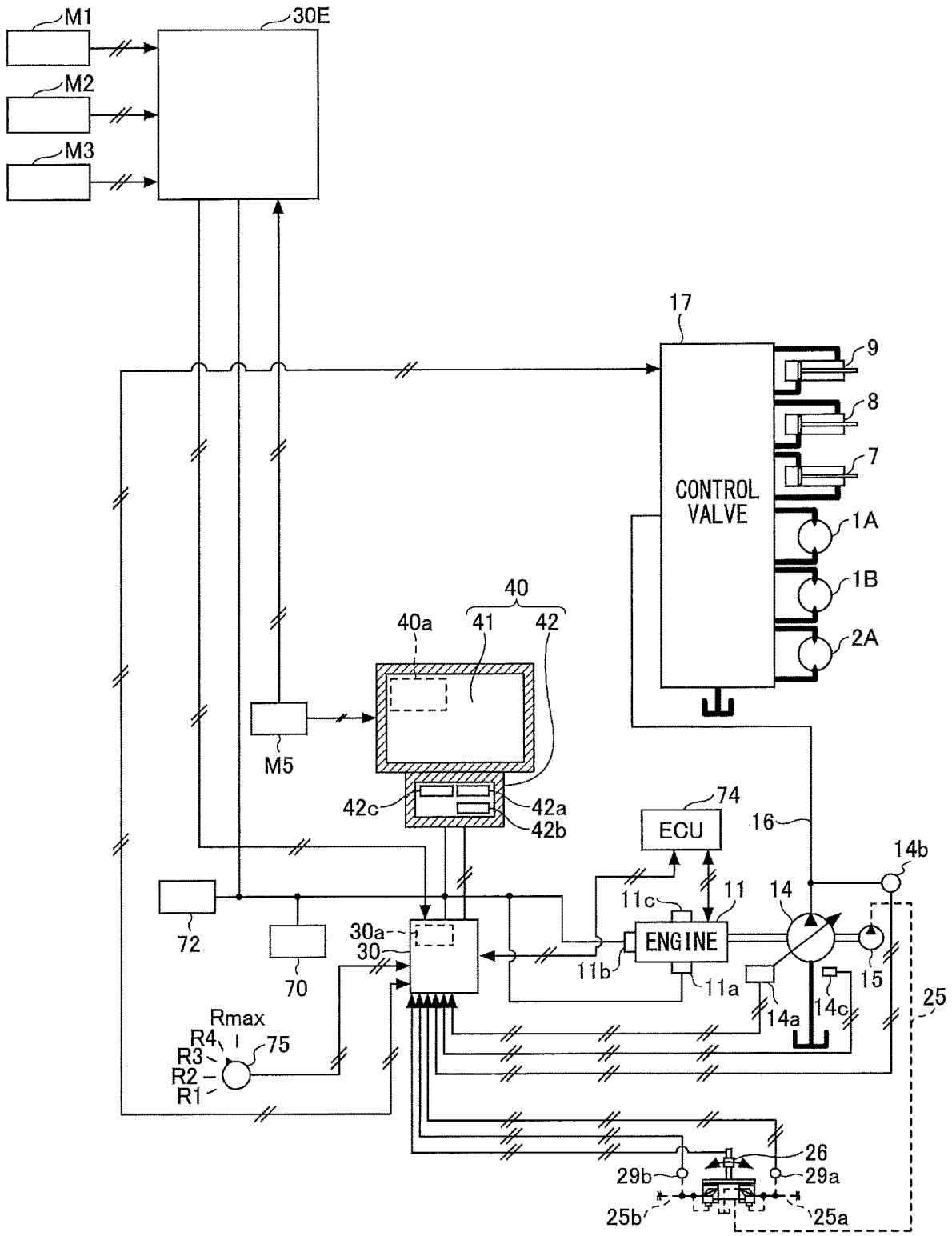
FIG. 3 is a diagram illustrating a configuration example of a basic system mounted on an excavator of FIG. 1.

Next, a basic system of the excavator will be described with reference to FIG. 3. FIG. 3 is a diagram illustrating an example of a configuration of the basic system of the excavator, in which a mechanical power transmission line, a hydraulic oil line, and a pilot line are represented by a double line, a solid line, and a dashed line, respectively. The basic system of the excavator mainly includes the engine 11, a main pump 14, a pilot pump 15, a control valve 17, an operation device 26, a controller 30, an engine control unit (ECU) 74, and the like.

The engine 11 is a driving source of the excavator, for example a diesel engine that operates to maintain predetermined speed. An output shaft of the engine 11 is connected to respective input shafts of the main pump 14 and the pilot pump 15.

The main pump 14 is a hydraulic pump that supplies hydraulic oil to the control valve 17 via a hydraulic oil line 16, for example a swash plate type variable displacement hydraulic pump. The main pump 14 adjusts a stroke length of a piston by changing an angle (tilted angle of the swash plate) of the swash plate, and thereby is capable of changing a discharge amount, that is, pumping power. The tilted angle of the swash plate of the main pump 14 is controlled by a regulator 14*a*. The regulator 14*a* changes the tilted angle of the swash plate in response to a change in control current received by an attached solenoid valve (not illustrated). For example, as the control current increases, the regulator 14*a* increases the tilted angle of the swash plate to increase a discharge amount of the main pump 14. As the control current decreases, the regulator 14*a* reduces the tilted angle of the swash plate to reduce the discharge amount of the main pump 14.

The pilot pump 15 is a hydraulic pump for supplying hydraulic oil to various hydraulic control devices via a pilot line 25. An example of the pilot pump 15 includes a fixed displacement hydraulic pump.

The control valve 17 is a set of hydraulic control valves that control a hydraulic system installed in the excavator. In the present embodiment, the control valve 17 includes multiple flow control valves. For example, the control valve 17 selectively supplies the hydraulic oil supplied from the main pump 14 through the hydraulic oil line 16, to one or more hydraulic actuators in accordance with an operating direction of the operation device 26 and an operating amount of the operation device 26. The hydraulic actuator includes, for example, the boom cylinder 7, the arm cylinder 8, the bucket cylinder 9, a left driving hydraulic motor 1A, a right driving hydraulic motor 1B, and a rotating hydraulic motor 2A. The left driving hydraulic motor 1A, the right driving hydraulic motor 1B, and the rotating hydraulic motor 2A may be configured by electric motors.

The operation device 26 is a device used by an operator for an operation of the hydraulic actuator, and includes a lever, pedal, and the like. In the present embodiment, hydraulic oil is supplied from the pilot pump 15 to the operation device 26 via the pilot line 25. The operation device 26 then supplies the hydraulic oil, through pilot lines 25*a* and 25*b*, to pilot ports of the corresponding flow control valves of the hydraulic actuators. Pressure of the hydraulic oil supplied to each of the pilot ports is in accordance with an operating direction and an operating amount of the corresponding operation device 26 of the corresponding hydraulic actuator.

The controller 30 is a control device for controlling the excavator, and is configured by, for example, a computer including a CPU, a RAM, a ROM, and the like. The controller 30 realizes various functions by executing programs corresponding to the various functions. The various functions include a function of controlling a discharge amount of the main pump 14 by changing magnitude of control current to the solenoid valve of the regulator 14*a*.

The engine control unit (ECU) 74 is configured to control the engine 11. For example, the ECU 74 controls a revolution speed (hereinafter referred to as an "engine RPM") of the engine 11 based on an instruction from the controller 30. The operator sets an engine RPM by using an engine speed adjusting dial 75 for example. The ECU 74 controls a fuel injection amount or the like to achieve the set engine RPM.

The engine speed adjusting dial 75 is a dial for adjusting the engine RPM of the engine 11, and is provided in the cab 10. In the present embodiment, the engine RPM can be switched in five levels. The operator can switch the engine RPM in the five levels of Rmax, R4, R3, R2, and R1 by operating the engine speed adjusting dial 75. FIG. 3 illustrates a state in which R4 is selected at the engine speed adjusting dial 75.

The image display device 40 is a device for displaying various information, and is provided in the cab 10. In the present embodiment, the image display device 40 includes an image display unit 41 and an input unit 42. The operator can confirm an operation status or control information of the excavator by viewing the image display unit 41. The operator can input various information to the controller 30 using the input unit 42. The image display device 40 is connected to the controller 30 via a communication network such as a CAN or a LIN. However, the image display device 40 may be connected to the controller 30 via a dedicated line.

The image display device 40 includes a conversion processing unit 40*a* that generates an image for display. In the present embodiment, the conversion processing unit 40*a* generates a camera image for display based on an output of an imaging device M5, which is a device for acquiring a surface condition of an article on the ground (note that the article may also be referred to as a feature). The imaging device M5 is a monocular camera connected to the image display device 40 via, for example, a dedicated line. The imaging device M5 may be a stereo camera, a range camera (range image sensor), an infrared camera, a thermographic camera, or the like. The conversion processing unit 40*a* may generate an image for display based on an output of the controller 30.

The conversion processing unit 40*a* may be implemented as a function of the controller 30, rather than as a function of the image display device 40. In this case, the imaging device M5 is connected to the controller 30, instead of the image display device 40.

The image display device 40 operates powered by a battery 70. The battery 70 is charged using electric power generated by an alternator 11*a* (generator) of the engine 11. Electric power of the battery 70 is supplied to the controller 30, the image display device 40, an electrical component 72 of an excavator, and the like. A starter 11*b* is actuated by electric power from the battery 70 to start the engine 11.

The ECU 74 transmits various data indicating a status of the engine 11 to the controller 30. Examples of the various data include data indicating a cooling water temperature output by a water temperature sensor 11*c*, data indicating a tilted angle of the swash plate of the main pump 14, which is output by the regulator 14*a*, data indicating discharge pressure of the main pump 14, which is output by the discharge pressure sensor 14*b*, data indicating a temperature of the hydraulic oil, which is output by the oil temperature sensor 14*c*, data indicating pilot pressure output by operation pressure sensors 29*a* and 29*b*, and data indicating an engine RPM setting status output by the engine speed adjusting dial 75. The controller 30 can store the data in a temporary storage unit 30*a*, and can transmit the data to the image display device 40 when necessary.

An external computing device 30E is a control device that performs various arithmetic operations based on an output from at least one of the communication device M1, the positioning device M2, the orientation detecting device M3, and the imaging device M5, and outputs a result of the arithmetic operation to the controller 30. In the present embodiment, the external computing device 30E operates by electric power supplied from the battery 70.

Figure 4:
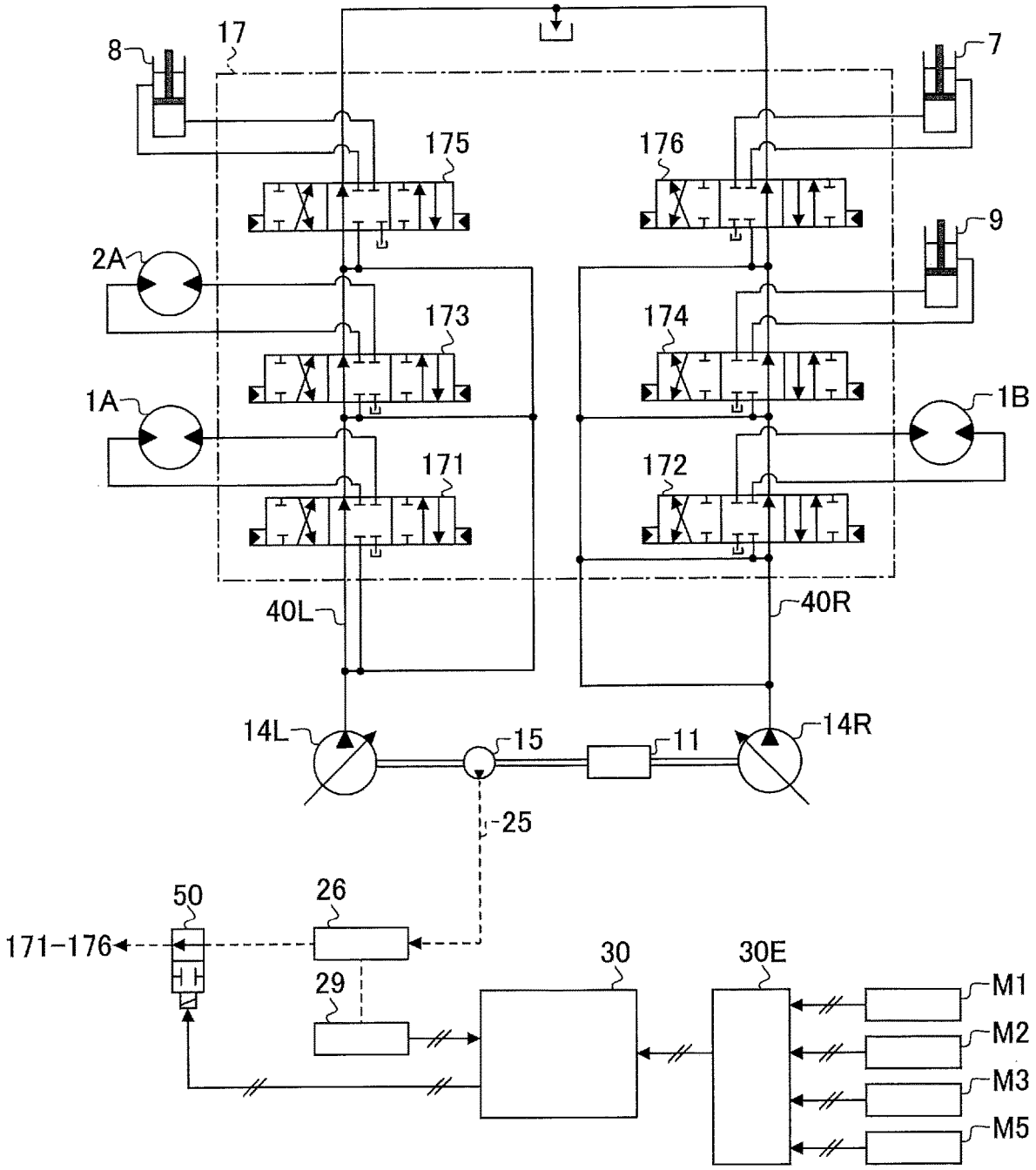
FIG. 4 is a diagram illustrating an example of a configuration of a hydraulic system mounted on an excavator of FIG. 1.

FIG. 4 is a diagram illustrating an example of a configuration of a hydraulic system installed in the excavator. The hydraulic system primarily includes main pumps 14L and 14R, the pilot pump 15, the control valve 17, the operation device 26, a changeover valve 50, and the like. The main pumps 14L and 14R correspond to the main pump 14 of FIG. 3.

The control valve 17 includes flow control valves 171 to 176 for controlling a flow of hydraulic oil discharged from the main pumps 14L and 14R. Through the flow control valves 171 to 176, the control valve 17 selectively supplies hydraulic oil discharged from the main pumps 14L and 14R to one or more of the boom cylinder 7, the arm cylinder 8, the bucket cylinder 9, the left driving hydraulic motor 1A, the right driving hydraulic motor 1B, and the rotating hydraulic motor 2A.

The operation detecting device 29 is configured to detect details of an operation of the operation device 26 by an operator. In the present embodiment, the operation detecting device 29 includes the operation pressure sensors 29*a* and 29*b* for detecting, as pressure, an operation direction and an operation amount of the operation device 26 for the corresponding hydraulic actuator. The operation detecting device 29 may be configured by a sensor other than a pressure sensor, such as a potentiometer.

The main pumps 14L and 14R driven by the engine 11 circulate hydraulic oil through the center bypass lines 40L and 40R, respectively, to a hydraulic oil tank. The center bypass line 40L is a hydraulic oil line passing through the flow control valves 171, 173 and 175 provided in the control valve 17. The center bypass line 40R is a hydraulic oil line passing through the flow control valves 172, 174 and 176 provided in the control valve 17.

The flow control valves 171, 172, and 173 are spool valves that control flow rates and flow directions of hydraulic oil flowing into and out of the left driving hydraulic motor 1A, the right driving hydraulic motor 1B, and the rotating hydraulic motor 2A, respectively. The flow control valves 174, 175, and 176 are spool valves that control flow rates and flow directions of hydraulic oil flowing into and out of the bucket cylinder 9, the arm cylinder 8, and the boom cylinder 7, respectively.

The left driving hydraulic motor 1A and the right driving hydraulic motor 1B are driving hydraulic motors that drive the lower traveling body 1. In the present embodiment, the driving hydraulic motor is a swash plate type variable displacement hydraulic motor, and is configured to switch a driving mode between a high-speed driving mode of high-speed and low-torque and a low-speed driving mode of low-speed and high-torque. Switching of the driving mode is accomplished by a motor regulator attached to the driving hydraulic motor. The motor regulator can switch the driving mode of the driving hydraulic motor according to at least one of a command from the controller 30, a driving load (pressure of hydraulic oil flowing through the driving hydraulic motor), and the like. In the high-speed driving mode, the tilted angle of the swash plate is small, and the pushing capacity (motor capacity) per rotation of the driving hydraulic motor is small. In the low-speed driving mode, the tilted angle of the swash plate is large and motor capacity is large.

The changeover valve 50 is a valve that switches a communication status between the operation device 26 and the respective pilot ports of the flow control valves 171 to 176, from a communicating state to a disconnected state (or from the disconnected state to the communicating state). In the present embodiment, the changeover valve 50 is a solenoid valve that switches a valve position of the solenoid valve in response to a control command from the controller 30. Specifically, the changeover valve 50 partially or completely disconnects communication between the operation device 26 and each of the pilot ports when a disconnect command is received from the controller 30, and cancels the disconnected state between the operation device 26 and each of the pilot ports when receiving a communication command. The changeover valve 50 may be a proportional solenoid valve capable of controlling a flow rate.

Figure 5:
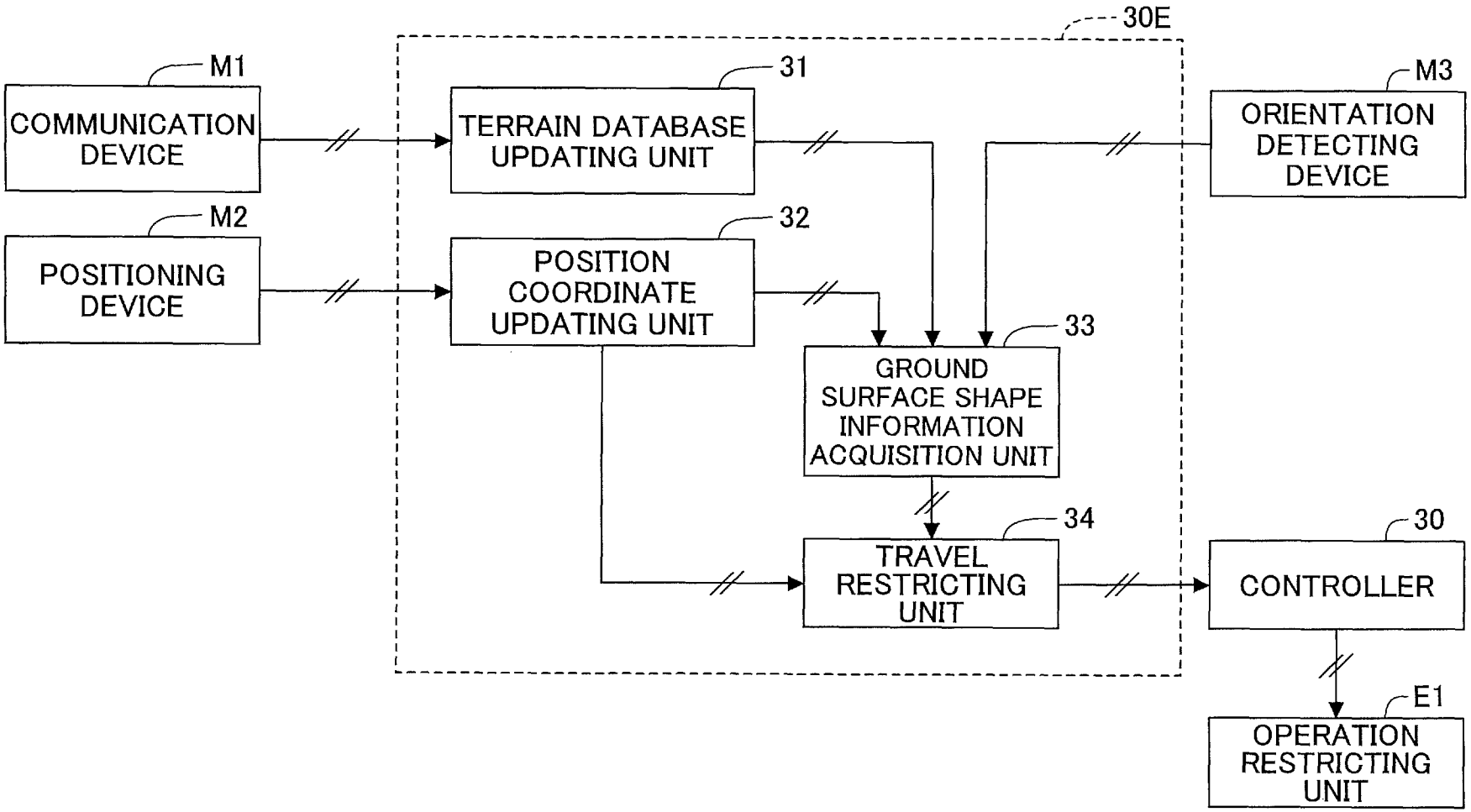
FIG. 5 is a diagram illustrating an example of a configuration of an external computing device.

Next, functions of the external computing device 30E will be described with reference to FIG. 5. FIG. 5 is a functional block diagram illustrating an example of a configuration of the external computing device 30E. In the present embodiment, the external computing device 30E performs various arithmetic operations by receiving outputs from the communication device M1, the positioning device M2, and the orientation detecting device M3, and outputs a result of the arithmetic operations to the controller 30. For example, the controller 30 outputs a control command according to the result of the arithmetic operations to an operation restricting unit E1.

The operation restricting unit E1 is a functional element for limiting movement of the excavator, and includes, for example, a regulating valve for adjusting pilot pressure, or a changeover valve which can shut off a flow of hydraulic oil from the main pump 14 to the control valve 17. In the present embodiment, the changeover valve 50 is employed as the operation restricting unit E1. The operation restricting unit E1 may include a warning output device that outputs a warning to an operator of the excavator. The warning output device may be, for example, an audio output device or a warning lamp.

The external computing device 30E mainly includes a terrain database updating unit 31, a position coordinate updating unit 32, a ground surface shape information acquisition unit 33, and a travel restricting unit 34.

The terrain database updating unit 31 is a functional element for updating a terrain database which systematically and accessibly stores terrain information of a work site for reference. In the present embodiment, when, for example, the excavator is started, the terrain database updating unit 31 acquires terrain information of a work site through the communication device M1, and updates the terrain database. The terrain database is stored in a non-volatile memory or the like. The terrain information of a work site is described, for example, by a three-dimensional terrain model based on the World Geodetic System.

The position coordinate updating unit 32 is a functional element that updates coordinates and a direction representing a current position of the excavator. In the present embodiment, the position coordinate updating unit 32 acquires coordinates of a position of the excavator and a direction of the excavator in the World Geodetic System, based on an output of the positioning device M2, and updates data about coordinates and a direction representing the current position of the excavator stored in the non-volatile memory or the like. The position coordinate updating unit 32 may acquire coordinates of a position and a direction of the excavator based on dead reckoning using an output of a gyro sensor, an acceleration sensor, or the like.

The ground surface shape information acquisition unit 33 is a functional element that acquires information about a current shape of the ground of a work target. In the present embodiment, the ground surface shape information acquisition unit 33 acquires the information about the current shape of the ground of the work target based on the terrain information updated by the terrain database updating unit 31, the coordinates and the direction representing the current position of the excavator updated by the position coordinate updating unit 32, and past changes (operation history) of an orientation of the excavation attachment detected by the orientation detecting device M3. Therefore, the ground surface shape information acquisition unit 33 can acquire information about a change in terrain around the upper turning body 3, including information about a change in the terrain caused by excavation work. The operation history, which includes past changes in the orientation of the excavation attachment, is time series data of, for example, at least one of the boom angle θ1, the arm angle θ2, the bucket angle θ3, the tilt angle θ4 about the Y-axis of the excavator, and the tilt angle θ5 about the X-axis of the excavator, and is stored in a volatile memory or a non-volatile memory. After the ground surface shape information acquisition unit 33 has acquired information about the current shape of the ground of the work target, the ground surface shape information acquisition unit 33 may delete the operation history theretofore. The ground surface shape information acquisition unit 33 may acquire information about the current shape of the ground of the work target based on the coordinates and the direction representing the current position of the excavator updated by the position coordinate updating unit 32, and the past changes (operation history) of the orientation of the excavation attachment detected by the orientation detecting device M3.

The travel restricting unit 34 is a functional element that restricts movement of the excavator. In the present embodiment, the travel restricting unit 34 restricts movement of the lower traveling body 1 based on the information about the coordinates and the direction representing the current position of the excavator updated by the position coordinate updating unit 32, and based on the information on the current shape of the ground of the work target acquired by the ground surface shape information acquisition unit 33. For example, when it is determined that a predetermined article exists within a predetermined distance in the forward direction of the lower traveling body 1, the travel restricting unit 34 restricts a forward movement of the lower traveling body 1. When it is determined that a predetermined article exists within a predetermined distance in the backward direction of the lower traveling body 1, a backward movement of the lower traveling body 1 is restricted. The predetermined article is, for example, an article that meets a predetermined condition, among articles formed by excavation work, such as a hole and an embankment. In the present embodiment, examples of the predetermined article includes a hole deeper than a predetermined depth, a hole having a side surface (inclined surface) whose tilt angle is greater than a predetermined angle, an embankment whose height is higher than a predetermined height, and an embankment having a side surface (inclined surface) whose tilt angle is greater than a predetermined angle. An orientation of the excavator becomes extremely unstable if the lower traveling body 1 passes through the predetermined article. The forward direction and the backward direction of the lower traveling body 1 are determined based on an output of the positioning device M2, for example.

Among holes formed by the excavation work, the travel restricting unit 34 determines, as a predetermined article, a hole having a side surface whose tilt angle is equal to or greater than a predetermined angle, and excludes a hole whose tilt angle of a side surface is less than the predetermined angle from the predetermined article. Alternatively, among holes formed by the excavation work, a hole having a predetermined depth or deeper than the predetermined depth may be selected as a predetermined article, and a hole having a depth less than the predetermined depth may be excluded from the predetermined article. Similarly, among embankments formed by the excavation work, the travel restricting unit 34 determines, as a predetermined article, an embankment having a side surface (inclined surface) whose tilt angle is equal to or greater than a predetermined angle, and an embankment whose tilt angle of a side surface is less than a predetermined angle is excluded from a predetermined article. Alternatively, among embankments formed by the excavation work, an embankment having a height equal to or higher than a predetermined height may be selected as a predetermined article, and an embankment less than the predetermined height may be excluded from the predetermined article.

Restriction of movement of the excavator includes at least one of maximum moving speed limit of the lower traveling body 1, maximum moving acceleration limit of the lower traveling body 1, maximum travel distance limit of the lower traveling body 1, and prohibition of movement of the lower traveling body 1. In the present embodiment, when the travel restricting unit 34 determines that a predetermined article exists within a predetermined distance in the forward direction of the lower traveling body 1, the travel restricting unit 34 outputs a result of the determination to the controller 30. Upon receiving the result of the determination, the controller 30 outputs a disconnect command to the changeover valve 50 as the operation restricting unit E1. The changeover valve 50 having received the disconnect command disconnects communication between the operation device 26 as a driving operation device and a right pilot port of each of the flow control valve 171 and the flow control valve 172, to prohibit forward movement of the excavator. The driving operation device includes a driving lever and a driving pedal. The maximum forward moving speed may be limited by lowering an upper limit of pilot pressure applied to the right pilot port of each of the flow control valve 171 and the flow control valve 172. Alternatively, when a distance to a predetermined article becomes less than a predetermined value, the excavator may be caused to stop moving forward.

In order to limit moving speed of the lower traveling body 1, the controller 30 may fix the driving mode of the driving hydraulic motor to the low-speed driving mode by outputting a command to the motor regulator as the operation restricting unit E1.

In the present embodiment, the lower traveling body 1 includes a left crawler and a right crawler. The controller 30 may limit movement of the left and right crawlers simultaneously, or may limit movement of the left and right crawlers individually.

According to this configuration, the controller 30 can prevent the excavator from falling into a hole as a predetermined article or from running on an embankment as a predetermined article, caused by an operator's mistake of operation. The operator's mistake of operation includes a backward operation that is performed with intention of moving the lower traveling body 1 forward, and a forward operation that is performed with intention of moving the lower traveling body 1 backward.

Next, another configuration example of the external computing device 30E will be described with reference to FIG. 6. The external computing device 30E of FIG. 6 differs from the external computing device 30E of FIG. 5 in that the ground surface shape information acquisition unit 33 can acquire information on a current shape of the ground of a work target based on an output of the imaging device M5, but other respects are the same in both the external computing device 30E of FIG. 6 and the external computing device 30E of FIG. 5. Thus, descriptions of common parts are omitted, and the difference will be described in detail.

The imaging device M5 may be attached to the excavation attachment or to the cab 10, so that the imaging device M5 can rotate together with the upper turning body 3 and that the imaging device M5 can capture surrounding terrain. However, the imaging device M5 may be attached to a pole or the like installed at a work site, or may be attached to a flying object that flies around the excavator. An example of the flying object includes a multicopter and an airship.

Figure 6:
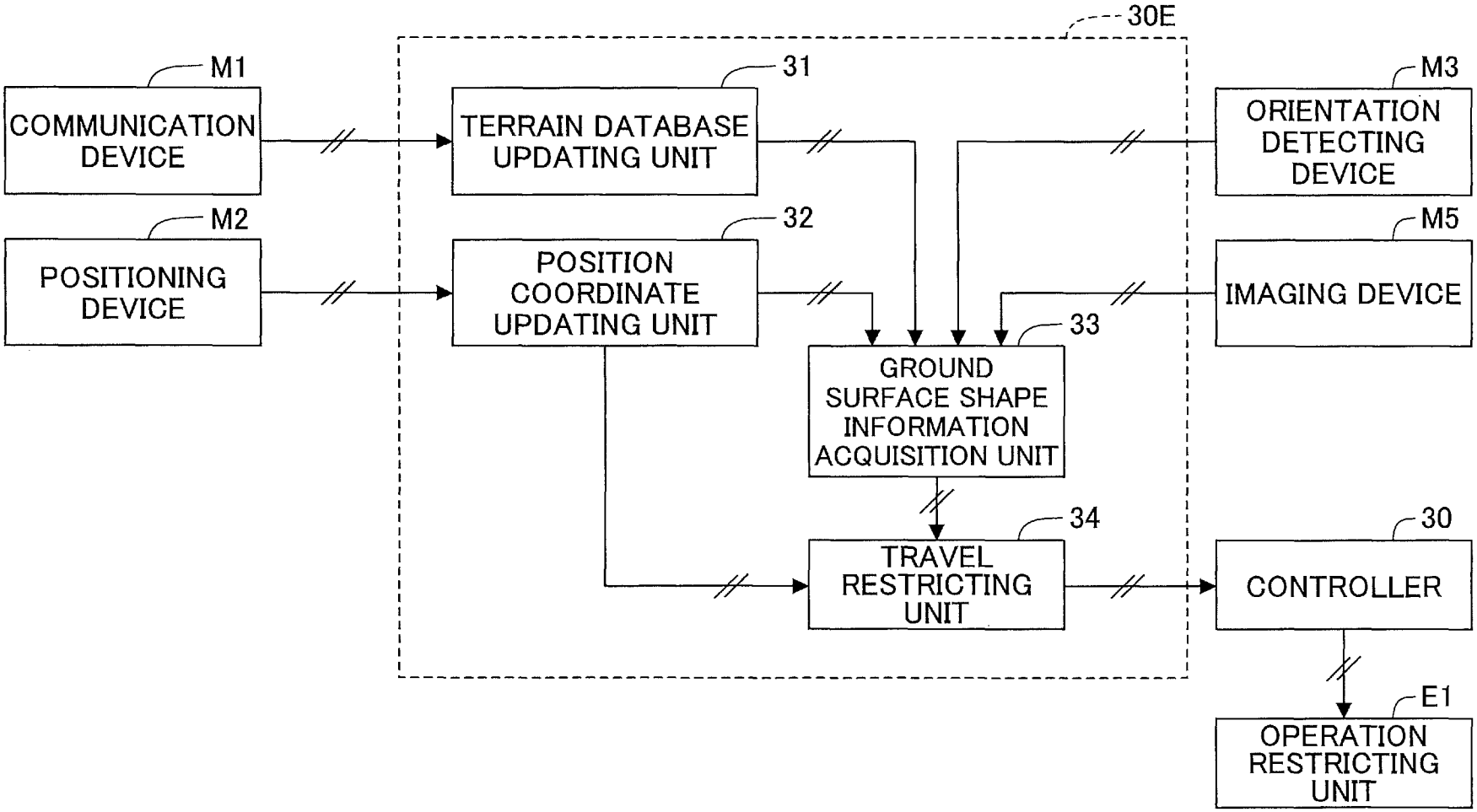
FIG. 6 is a diagram illustrating another configuration example of an external computing device.

In the example of FIG. 6, the ground surface shape information acquisition unit 33 can acquire information regarding a current shape of the ground of a work target based on a range image output by the imaging device M5, which is, for example, a stereo camera or a range camera. In a case in which the imaging device M5 is attached to the excavation attachment, the range image is converted to a range image with the positioning device M2 (excavator) as a reference point, based on a relative positional relationship between the positioning device M2 and the imaging device M5. In a case in which the imaging device M5 is attached to a pole, the range image is converted to a range image with the positioning device M2 (excavator) as a reference point, based on an attached location (latitude, longitude, altitude) of the imaging device M5 that is measured in advance. In a case in which the imaging device M5 is attached to a flying object, the range image is converted into a range image with the positioning device M2 (excavator) as a reference point, based on an output of the positioning device M2 and an output of a positioning device mounted on the flight body.

The ground surface shape information acquisition unit 33 may acquire information regarding a current shape of the ground of a work target based on an output of a range finding device, such as LIDAR or a laser rangefinder, which is a device for acquiring a surface condition of an article. In this case, similarly to the imaging device M5, the range finding device may be attached to the excavation attachment, to a pole or the like installed at a work site, or to a flying object flying around the excavator. Conversion of distance information measured by the range finding device to distance information with the excavator as a reference point may be performed in the same manner as described above.

As described above, the imaging device M5 may be separate from the excavator. In this case, the controller 30 may acquire terrain information output by the imaging device M5 through the communication device M1. Specifically, the imaging device M5 may be attached to a multicopter for an aerial shoot or to a steel tower installed at a work site, and may acquire terrain information of the work site based on an image of the work site viewed from above. Further, the imaging device M5 may be another imaging device M5 attached to another excavator. In a case in which the imaging device M5 is separate from the excavator, the imaging device M5 may transmit data to the excavator directly, or may transmit data to the excavator via a management device. The management device is, for example, a computer provided at an external facility, such as a control center. In a case in which the imaging device M5 is separate from the excavator as described above, the terrain database updating unit 31 acquires, through the communication device M1, terrain information from the external imaging device M5 or terrain information from the management device. The terrain database updating unit 31 updates the terrain information around the excavator based on the acquired terrain information, and the ground surface shape information acquisition unit 33 can acquire information on terrain change, based on the terrain information updated by the terrain database updating unit 31.

According to this configuration, the controller 30 can more reliably prevent the excavator from falling into a hole as a predetermined article or from running on an embankment as a predetermined article caused by an operator's mistake of operation.

Figure 7:
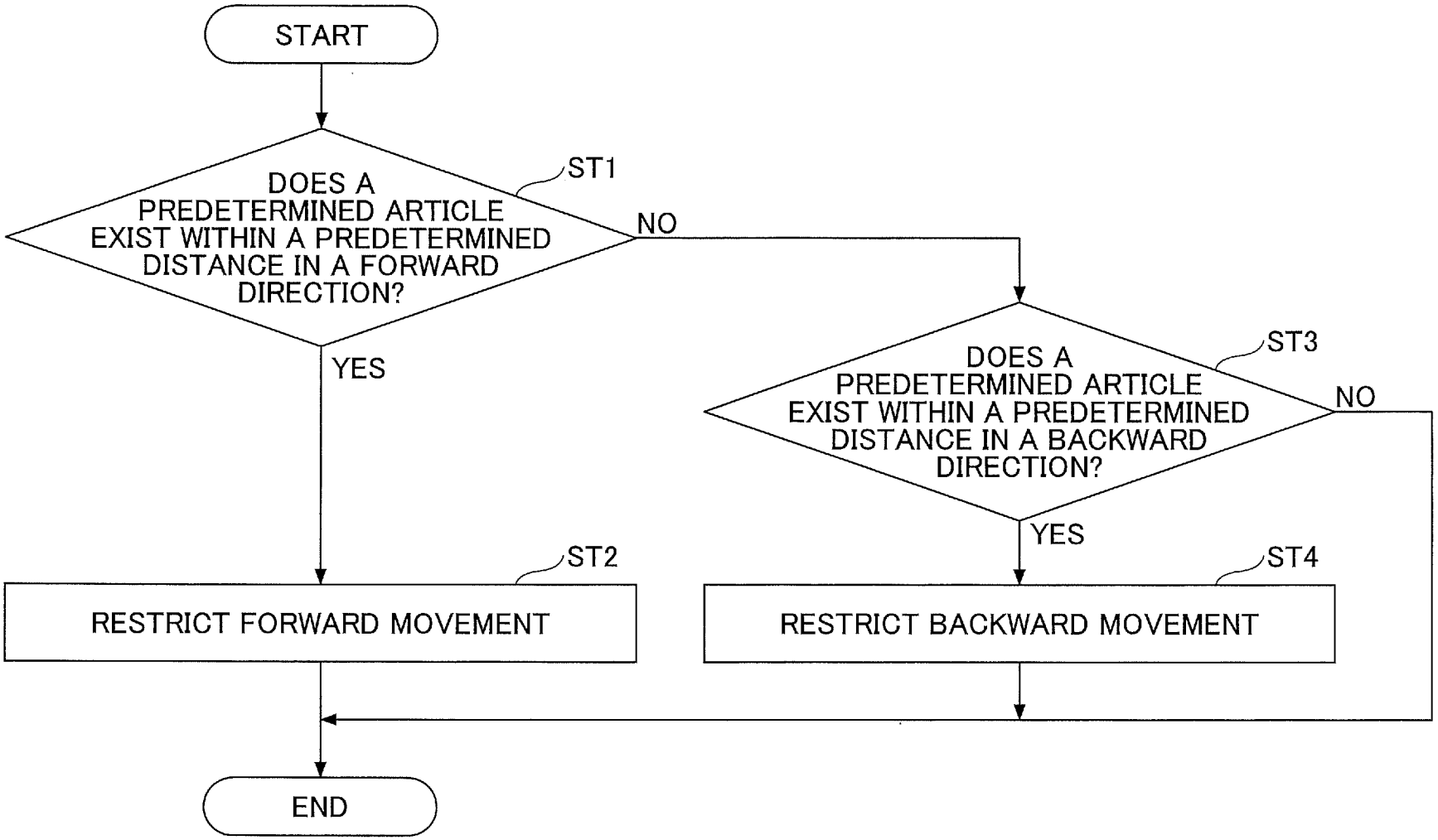
FIG. 7 is a flowchart of the travel restricting process.
Figure 8A:
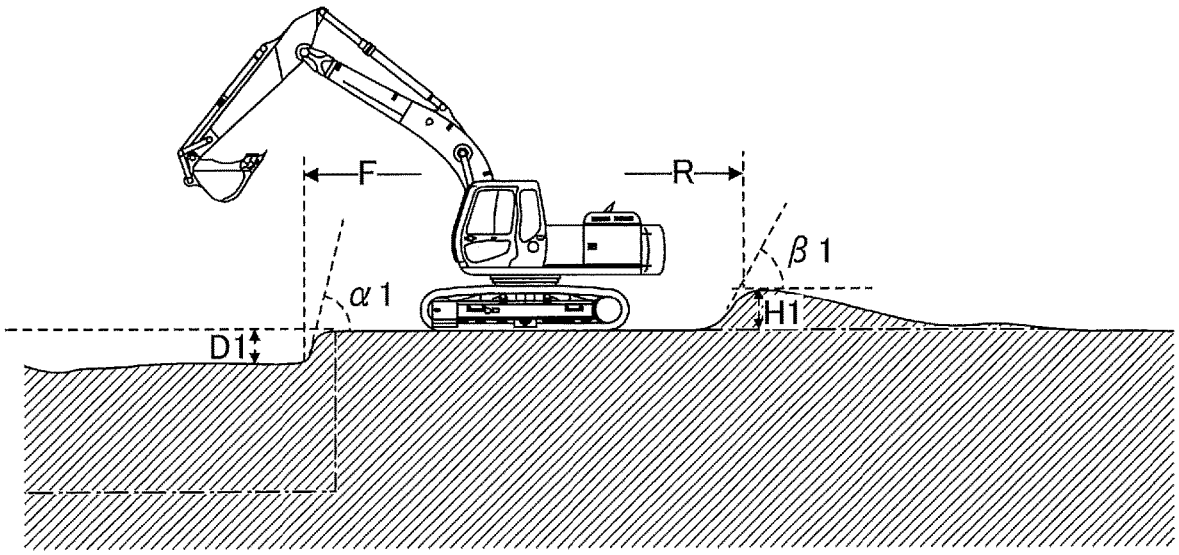
FIG. 8A is a cross-sectional view of a work target ground.
Figure 8B:
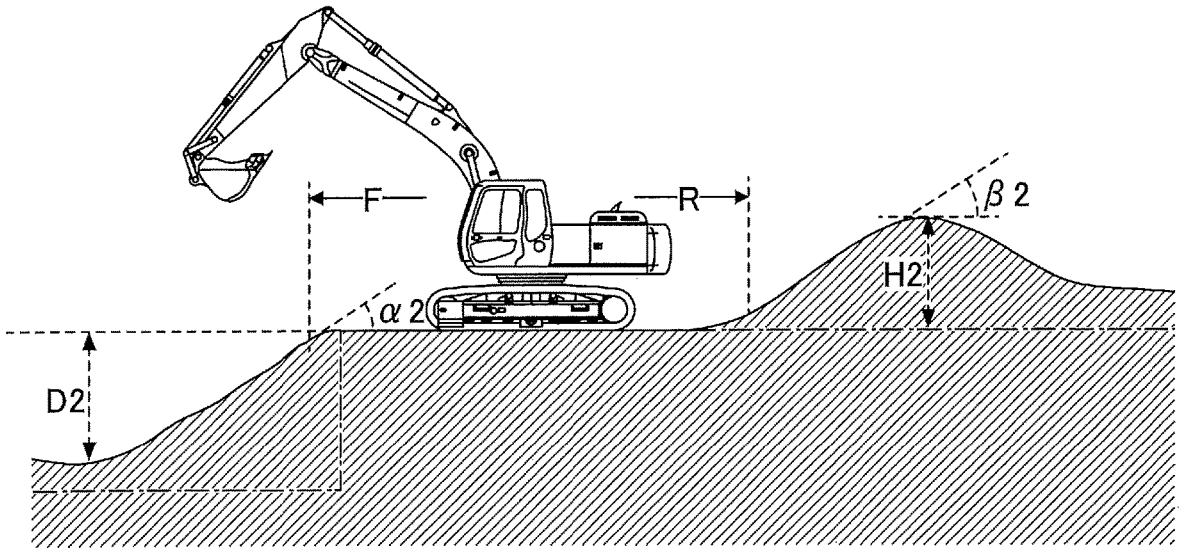
FIG. 8B is a cross-sectional view of the work target ground.
Figure 8C:
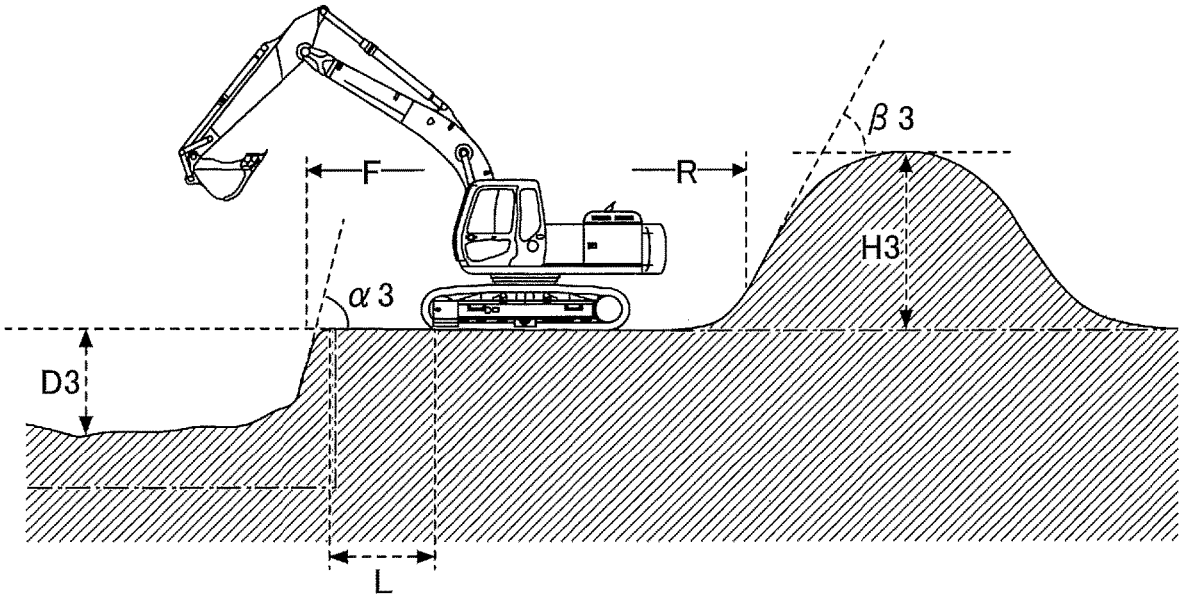
FIG. 8C is a cross-sectional view of the work target ground.

Next, a process in which the controller 30 restricts movement of the lower traveling body 1 (hereinafter, referred to as "travel restricting process") will be described with reference to FIG. 7 and FIGS. 8A to 8C. FIG. 7 is a flowchart of the travel restricting process. The controller 30 repeatedly performs this travel restricting process at a predetermined control cycle. The ground surface shape information acquisition unit 33 of the controller 30 acquires information on a current shape of the ground of a work target, in parallel with the travel restricting process. Typically, the ground surface shape information acquisition unit 33 periodically acquires information on the current shape of the ground of a work target, based on the terrain information updated by the terrain database updating unit 31, the coordinates and the direction representing the current position of the excavator updated by the position coordinate updating unit 32, and the past changes (operation history) of the orientation of the excavation attachment detected by the orientation detecting device M3. FIGS. 8A to 8C are cross-sectional views of the ground of a work target, illustrating change of the shape of the ground in an order of FIGS. 8A, 8B, and 8C. The dashed dotted line in each of the FIGS. 8A to 8C represents target terrain (a shape of the ground to be realized by the excavation work). The excavator acquires data about the target terrain through the communication device M1.

First, the travel restricting unit 34 of the controller 30 determines whether or not a predetermined article exists within a predetermined distance in a forward direction (step ST1). In this example, a predetermined article includes a hole that is deeper than a predetermined depth TH1 and that has a side surface whose tilt angle is greater than a predetermined angle TH2, and includes an embankment that is higher than a predetermined height TH3 and that has a side surface whose tilt angle is greater than a predetermined angle TH4.

For example, the travel restricting unit 34 recognizes a shape of a predetermined article and a distance to the predetermined article, and determines whether or not the predetermined article exists within the predetermined distance in the forward direction. The predetermined distance in the forward direction is, for example, a horizontal distance from a front end of the lower traveling body 1.

If it is determined that a predetermined article exists within the predetermined distance in the forward direction (YES in step ST1), the travel restricting unit 34 restricts forward movement (step ST2).

If it is determined that a predetermined article does not exist within the predetermined distance in the forward direction (NO in step ST1), the travel restricting unit 34 determines whether or not a predetermined article exists within a predetermined distance in a backward direction (Step ST3).

If it is determined that a predetermined article exists within the predetermined distance in the backward direction (YES in step ST3), the travel restricting unit 34 restricts backward movement (step ST4). The predetermined distance in the backward direction is, for example, a horizontal distance from a rear end of the lower traveling body 1.

If it is determined that a predetermined article does not exist within the predetermined distance in the backward direction (NO in step ST3), that is, when it is determined that the predetermined article does not exist in both the forward direction and the backward direction, the travel restricting unit 34 terminates the travel restriction process without restricting either the forward movement or the backward movement.

In the example of FIG. 7, the travel restricting unit 34 determines whether or not a predetermined article exists within a predetermined distance in the backward direction, after the travel restricting unit 34 has determined that a predetermined article does not exist within a predetermined distance in the forward direction. However, the travel restricting unit 34 may determine whether or not a predetermined article exists within a predetermined distance in the forward direction after determining that a predetermined article does not exist within a predetermined distance in the backward direction. Alternatively, the two determinations may be performed in parallel.

For example, in the state of FIG. 8A, because there is only a hole with a depth D1 that is less than the predetermined depth TH1 within a predetermined distance F in the forward direction, the travel restricting unit 34 determines that no predetermined article is present in the forward direction. Although this hole has a side surface having a tilt angle $\alpha$1 greater than the predetermined angle TH2, this hole is not determined to be a predetermined article because the depth D1 is less than the predetermined depth TH1. Therefore, the travel restricting unit 34 does not restrict forward movement. However, the hole of the depth D1 may be determined to be a predetermined article because of the tilt angle $\alpha$1 of its side wall being greater than the predetermined angle TH2. In this case, the travel restricting unit 34 restricts forward movement.

In addition, because there is only an embankment having a height H1 less than the predetermined height TH3 within a predetermined distance R in the backward direction, the travel restricting unit 34 determines that no predetermined article is present in the backward direction. Although this embankment has a side wall of a tilt angle $\beta$1 greater than the predetermined angle TH4, this embankment is not determined to be a predetermined article because the height H1 is less than the predetermined height TH3. Therefore, the travel restricting unit 34 does not restrict backward movement. However, the embankment of height H1 may be determined to be a predetermined article because of the tilt angle $\beta$1 of the side wall being greater than the predetermined angle TH4. In this case, the travel restricting unit 34 restricts backward movement.

In the state of FIG. 8B, a hole reaching a depth D2 equal to or greater than the predetermined depth TH1 is present within a predetermined distance F in the forward direction. However, because a tilt angle $\alpha$2 of the side wall of the hole is less than the predetermined angle TH2, the travel restricting unit 34 determines that no predetermined article is present in the forward direction. Further, there is an embankment reaching a height H2 equal to or greater than the predetermined height TH3 within a predetermined distance R in the backward direction. However, because a tilt angle $\beta$2 of the side wall of the embankment is less than the predetermined angle TH4, the travel restricting unit 34 determines that no predetermined article is present in the backward direction. Therefore, the travel restricting unit 34 does not restrict the forward movement or the backward movement. However, the travel restricting unit 34 may determine that the hole existing within the predetermined distance F in the forward direction is a predetermined article because of its depth reaching the depth D2. In addition, the embankment existing within the predetermined distance R in the backward direction may be determined to be a predetermined article because of its height reaching the height H2.

In the state of FIG. 8C, within a predetermined distance F in the forward direction, there is a hole reaching a depth D3 equal to or greater than the predetermined depth TH1 and having a tilt angle $\alpha$3 of the side wall of the hole that is equal to or greater than the predetermined angle TH2. Thus, the travel restricting unit 34 determines that a predetermined article is present in the forward direction, and the travel restricting unit 34 restricts forward movement. In addition, within the predetermined distance R in the backward direction, because there is an embankment reaching a height H3 equal to or greater than the predetermined height TH3 and having a tilt angle $\beta$3 of the side wall of the embankment that is equal to or greater than the predetermined angle TH4, the travel restricting unit 34 determines that a predetermined article is present in the backward direction. Therefore, the travel restricting unit 34 restricts backward movement.

The ground surface shape information acquisition unit 33 may set an area ranging from an edge of the hole determined to be a predetermined article to a location away from the edge by a distance L equivalent to the depth D3 of the hole, as a restricted area (restricted range), and may restrict movement of the lower traveling body 1 so as to prevent the excavator from entering the restricted range. In this case, by setting a range from the predetermined article to a predetermined distance as a restricted range, the ground surface shape information acquisition unit 33 can prevent the excavator from approaching the predetermined article, and safeness is further improved.

Figure 9A:
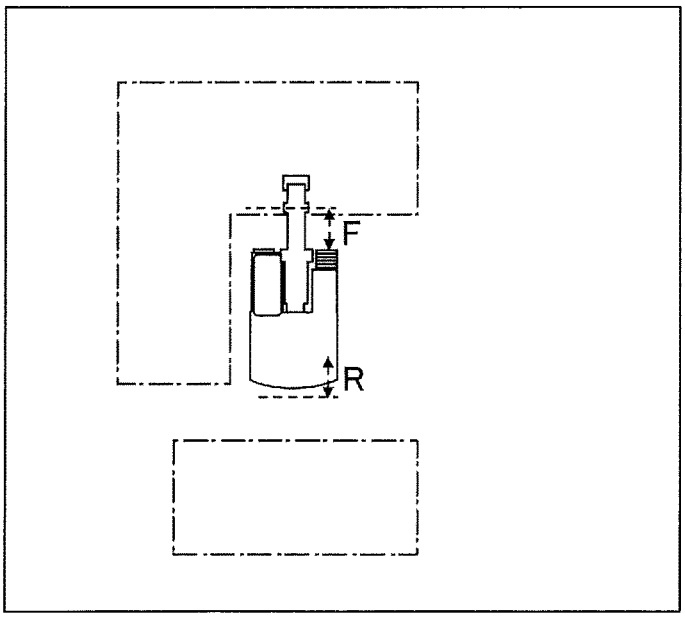
FIG. 9A is a top view of a work site.
Figure 9B:
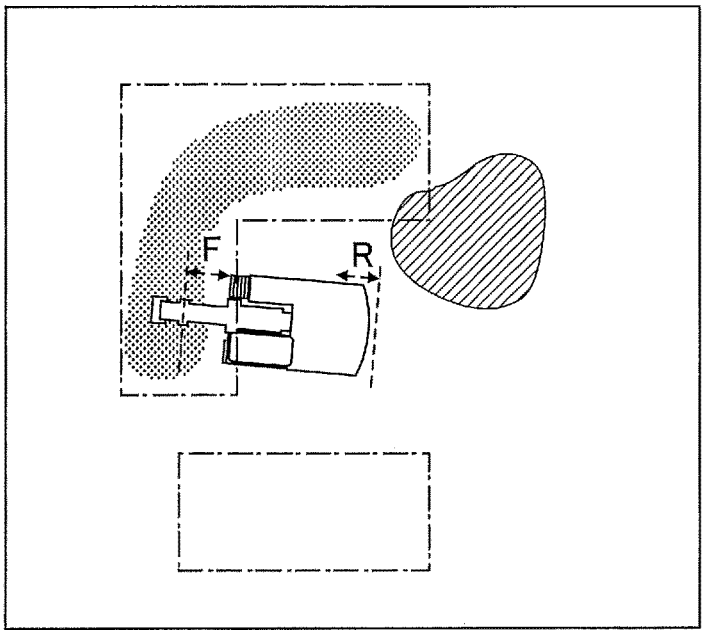
FIG. 9B is a top view of the work site.
Figure 9C:
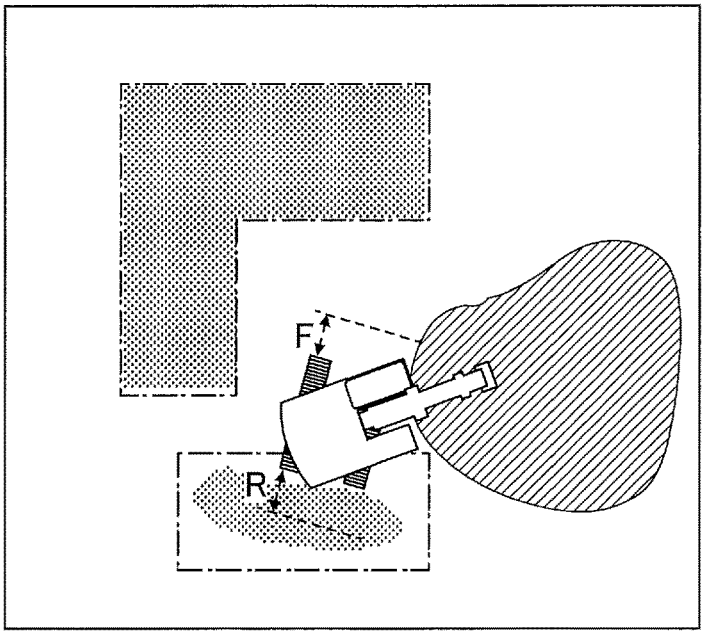
FIG. 9C is a top view of the work site.

Next, with reference to FIGS. 9A to 9C, a change in position of a predetermined article accompanied by progress of excavation work will be described. FIGS. 9A to 9C are top views of the work site, and illustrate that excavation proceeds in an order of FIGS. 9A, 9B, and 9C. Dashed dotted lines in each of FIGS. 9A to 9C represent locations of holes constituting target terrain. A dot pattern represents a location of a hole as a predetermined article. A pattern filled with diagonal stripes represents a location of an embankment as a predetermined article.

FIG. 9A illustrates a state of a work site before the excavation work is started. By the dashed dotted lines, it is indicated that two holes are to be formed. In the state of FIG. 9A, because a predetermined article does not exist, the travel restricting unit 34 does not restrict movement of the excavator.

FIG. 9B illustrates a state of the work site in which the excavator is excavating a first hole of the two holes. The dot pattern indicates that a hole as a predetermined article has been formed within an area corresponding to the first hole. The pattern filled with diagonal lines indicates that the embankment as a predetermined article has been formed by gravel that has been dug out in order to form the first hole. In the state of FIG. 9B, the travel restricting unit 34 restricts forward movement of the excavator. This is because the hole as a predetermined article exists within a predetermined distance F in the forward direction of the lower traveling body 1. However, the travel restricting unit 34 does not restrict backward movement of the excavator. This is because a predetermined article is not present within a predetermined distance R in the backward direction of the lower traveling body 1.

FIG. 9C illustrates a state of the work site when the excavator is excavating a second hole of the two holes after forming of the first hole has been completed. The dot patterns indicate that holes as predetermined articles have been formed within an area corresponding to the first hole and within an area corresponding to the second hole. The pattern filled with diagonal lines indicates that the embankment as a predetermined article has been formed by gravel that has been dug out in order to form the first and second holes. In the state of FIG. 9C, the travel restricting unit 34 restricts backward movement of the excavator. This is because a hole (the second hole) as a predetermined article is present within a predetermined distance R in the backward direction of the lower traveling body 1. Meanwhile, the travel restricting unit 34 does not restrict forward movement of the excavator. This is because a predetermined article is not present within the predetermined distance F in the forward direction of the lower traveling body 1.

As described above, the controller 30 restricts movement of the lower traveling body 1 when a predetermined article exists within a predetermined distance in a direction of movement. This can prevent the excavator from falling into a hole excavated by the excavator and from running on an embankment formed by the excavator. This restricting process is particularly effective in a case in which an operator has performed an operation to move the lower traveling body 1 in an opposite direction to an intended direction. Such a case may occur, for example, when an operator excessively concentrates on an operation of an attachment and misrecognizes a forward direction of the lower traveling body 1 as a backward direction. However, this restricting process is also effective when an operator moves the lower traveling body 1 in an intended direction. This is because a predetermined article such as a hole and an embankment is difficult to see from the cab 10, and it is difficult for an operator to recognize that the predetermined article exists, or an operator tends to forget that the predetermined article exists.

As described above, the excavator according to the embodiment of the present invention is configured such that the controller 30 restricts movement of the lower traveling body 1 based on information about terrain around the upper turning body 3. Typically, the excavator is configured such that the controller 30 restricts movement of the lower traveling body 1 based on information about change in terrain around the upper turning body 3. Therefore, the excavator according to the embodiment of the present invention can prevent the excavator from falling into an unstable state, in which, for example, the excavator is caught in a hole excavated by itself or by another excavator, or the excavator runs on an embankment made by itself or by another excavator.

The controller 30 may restrict movement of the lower traveling body 1 based on information about a change in terrain caused by excavation work. In particular, the controller 30 of the excavator restricts the movement of the lower traveling body 1 based on the information about a change in terrain caused by the excavator's excavation work. Therefore, the excavator equipped with the controller 30 can prevent the excavator from falling into an unstable state, in which, for example, the excavator is caught in a hole excavated by itself, or the excavator runs on an embankment made by itself.

The controller 30 may acquire information about the change in the terrain caused by the excavation work, based on an operation history of the attachment, which includes a detected value of the orientation detecting device M3. Therefore, the excavator equipped with the controller 30 can definitely and accurately obtain information about a hole excavated by the excavator and information about an embankment made by the excavator.

The controller 30 may acquire information about the change in the terrain around the upper turning body 3 based on an output of a device for acquiring a surface condition of an article (e.g., the imaging device M5 or the range finding device) or a device for acquiring a path of movement of the attachment (e.g., the orientation detecting device M3). Therefore, the excavator equipped with the controller 30 can definitely and accurately acquire information about a hole excavated by itself or by another excavator, information about an embankment made by itself or by another excavator, and the like, in a wide range of a work site.

The device for acquiring a surface condition of an article (e.g., the imaging device M5 or the range finding device) or the device for acquiring a path of movement of the attachment (e.g., the orientation detecting device M3) may be attached to the attachment. Therefore, the device for acquiring a surface condition of an article (e.g., the imaging device M5 or the range finding device) or the device for acquiring a path of movement of the attachment (e.g., the orientation detecting device M3) can capture, measure, or derive surrounding terrain over a wide area because an image capturing direction, a measurement direction, or an excavation position varies in accordance with turning of the upper turning body 3.

The lower traveling body 1 is typically driven by a variable displacement hydraulic motor. In this case, by fixing the driving mode of the hydraulic motor to a low-speed driving mode, that is, by configuring the driving mode not to be switched to a high-speed driving mode, the controller 30 can restrict movement of the lower traveling body 1. Thus, the controller 30 can simply and quickly restrict the movement of the lower traveling body 1.

The controller 30 may restrict at least one of a moving direction and moving speed of the lower traveling body 1. Therefore, the controller 30 can prevent the lower traveling body 1 from entering a predetermined article without limiting movement of the lower traveling body 1 in a direction away from the predetermined article.

The controller 30 may set a range from a predetermined article to a predetermined distance, as a restricted range. According to this configuration, the controller 30 can more reliably prevent the excavator from approaching the predetermined article, and safeness is further improved.

The controller 30 may be configured to acquire the information about the terrain around the upper turning body 3 from the imaging device M5 external to the excavator. This configuration makes it easier for the controller 30 to obtain terrain information about a work site.

The preferred embodiments of the present invention have been described above. However, the present invention is not limited to the embodiments described above. Various modifications, substitutions, and the like may be applied to the above-described embodiments without departing from the scope of the invention. Each of the features described with reference to the above-described embodiments may also be suitably combined, unless technical inconsistency occurs.

For example, the above-described embodiments have described that the external computing device 30E is another computing device external to the controller 30, but the external computing device 30E may be integrally integrated with the controller 30. Further, the external computing device 30E may not be installed in the excavator. For example, the external computing device 30E may be provided in an external control facility such as a control center. In this case, the external computing device 30E may receive data acquired by at least one of the positioning device M2, the orientation detecting device M3, and the imaging device M5 through the network, and may calculate information regarding terrain, such as finished-work information. The calculated information about terrain may be transmitted to the excavator. The excavator may restrict movement of the lower traveling body 1 based on the received information about terrain. Data acquired by a positioning device and an imaging device installed in a flying object may be transmitted from the flying object to the external computing device 30E. The external computing device 30E may calculate information about terrain based on the received data, and may transmit the information about terrain to the excavator. The flying object may calculate information about terrain and may transmit the information about terrain to the excavator directly.

What is claimed is:

1. An excavator comprising:

a lower traveling body;

an upper turning body equipped with an attachment, the upper turning body being mounted on the lower traveling body; and a controller installed in the upper turning body, the controller being configured to determine whether a predetermined article exists in a moving direction of the lower traveling body with respect to each of a forward direction and a backward direction of the lower traveling body based on information about terrain around the upper turning body, the predetermined article having a depth relative to a level of a ground at which the excavator is positioned, set a restricted range for the predetermined article in response to determining that the predetermined article exists, and restrict movement of the lower traveling body with respect to the restricted range set for the predetermined article.

2. The excavator according to claim 1, wherein the controller is configured to determine whether the predetermined article exists in the moving direction of the lower traveling body with respect to each of the forward direction and the backward direction of the lower traveling body based on information about a change in the terrain around the upper turning body.

3. The excavator according to claim 1, wherein the controller is configured to determine whether the predetermined article exists in the moving direction of the lower traveling body with respect to each of the forward direction and the backward direction of the lower traveling body based on information about a change in the terrain caused by excavation work.

4. The excavator according to claim 3, wherein the controller is configured to acquire the information about the change in the terrain caused by excavation work, based on an operation history of the attachment, the operation history including a detected value of an orientation detecting device.

5. The excavator according to claim 1, wherein the controller is configured to acquire information about a change in the terrain around the upper turning body, based on an output of a device configured to acquire a surface condition of an article or an output of a device configured to acquire a path of movement of the attachment.

6. The excavator according to claim 5, wherein the device configured to acquire the surface condition of the article or the device configured to acquire the path of movement of the attachment is attached to the attachment.

7. The excavator according to claim 1, wherein the lower traveling body is driven by a variable displacement hydraulic motor; and the controller is configured to restrict the movement of the lower traveling body, by fixing a driving mode of the variable displacement hydraulic motor to a low-speed driving mode.

8. The excavator according to claim 1, wherein the controller is configured to restrict the moving direction of the lower traveling body or moving speed of the lower traveling body.

9. The excavator according to claim 1, wherein the controller is configured to set a range from the predetermined article to a predetermined distance, as the restricted range.

10. The excavator according to claim 1, wherein the controller is configured to acquire the information about terrain around the upper turning body from an imaging device external to the excavator.

11. The excavator according to claim 1, wherein the controller is configured to recognize a distance to the predetermined article, to determine whether the predetermined article exists within a predetermined distance in the moving direction of the lower traveling body with respect to each of the forward direction and the backward direction of the lower traveling body, and to restrict forward movement of the lower traveling body in response to determining that the predetermined article exists within the predetermined distance in the forward direction of the lower traveling body, and to restrict backward movement of the lower traveling body in response to determining that the predetermined article exists within the predetermined distance in the backward direction of the lower traveling body.

12. The excavator according to claim 1, wherein the controller is configured to set the restricted range based on information acquired from an imaging device.

13. The excavator according to claim 1, wherein the controller is configured to set the restricted range based on information about coordinates representing a current position of the excavator.

14. The excavator according to claim 1, wherein the controller is configured to set a range of a predetermined distance from the predetermined article as the restricted range for the predetermined article.

15. The excavator according to claim 1, wherein the predetermined article is a hole in the ground.

16. The excavator according to claim 1, wherein the predetermined article is a hole, the hole having a depth greater than a predetermined depth; a side surface whose tilt angle relative to the level of the ground at which the excavator is positioned is greater than a predetermined angle; or a combination thereof.

17. The excavator according to claim 1, wherein the controller is configured to set a range of a predetermined distance from the predetermined article as the restricted range for the predetermined article, and the predetermined article is a hole in the ground.

18. An excavator comprising:

a lower traveling body;

an upper turning body equipped with an attachment, the upper turning body being mounted on the lower traveling body; and a controller installed in the upper turning body, the controller being configured to determine whether a predetermined article exists in a moving direction of the lower traveling body with respect to each of a forward direction and a backward direction of the lower traveling body based on information about coordinates representing a current position of the excavator, the predetermined article having a depth relative to a level of a ground at which the excavator is positioned, set a restricted range for the predetermined article in response to determining that the predetermined article exists, and restrict movement of the lower traveling body with respect to the restricted range set for the predetermined article.

19. The excavator according to claim 18, wherein the controller is configured to acquire information about a change in terrain around the upper turning body, based on an output of a device configured to acquire a surface condition of an article or an output of a device configured to acquire a path of movement of the attachment.

20. The excavator according to claim 18, wherein the controller is configured to acquire information about a change in terrain caused by excavation work, based on an operation history of the attachment, the operation history including a detected value of an orientation detecting device.

* * * * *